US009844777B2

(12) United States Patent
Izumo

(10) Patent No.: US 9,844,777 B2
(45) Date of Patent: Dec. 19, 2017

(54) PIPETTE TIP

(71) Applicant: A&D COMPANY, LIMITED, Tokyo (JP)

(72) Inventor: Naoto Izumo, Saitama (JP)

(73) Assignee: A&D COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/322,134

(22) PCT Filed: Jun. 27, 2014

(86) PCT No.: PCT/JP2014/067153

§ 371 (c)(1),
(2) Date: Dec. 26, 2016

(87) PCT Pub. No.: WO2015/198469

PCT Pub. Date: Dec. 30, 2015

(65) Prior Publication Data

US 2017/0136453 A1 May 18, 2017

(51) Int. Cl.
*B01L 3/02* (2006.01)

(52) U.S. Cl.
CPC ..... *B01L 3/0275* (2013.01)

(58) Field of Classification Search
CPC ..... B01L 3/02; B01L 3/021; B01L 3/0217; G01N 1/10
See application file for complete search history.

(56) References Cited

U.S. PATENT DOCUMENTS 4,971,763 A * 11/1990 Columbus ..... B01L 3/0275 222/420
2003/0165408 A1* 9/2003 Takeda ..... B01L 3/0275 422/525
2011/0183433 A1* 7/2011 Motadel ..... B01L 3/0275 436/180

FOREIGN PATENT DOCUMENTS

JP 3027864 U 8/1996
JP 2000-504994 A 4/2000
JP 2003-260372 A 9/2003
JP 2006-231326 A 9/2006
JP 2013-136052 A 7/2013

OTHER PUBLICATIONS

International Search Report dated Mar. 3, 2015 in the corresponding application PCT/JP2014/067153.

* cited by examiner

*Primary Examiner* — Jan Ludlow
(74) *Attorney, Agent, or Firm* — Roberts Mlotkowski Safran Cole & Calderon P.C.

(57) ABSTRACT

Provided is a pipette tip having a visual indicator capable of confirming depth of liquid in contact with the pipette tip during a suction work. In the pipette tip, a marker-is formed on an outer surface of the pipette tip in a circumference direction in a tip end area in a tip end side for confirming the depth of liquid in contact with the pipette tip. Thereby, the depth of liquid in contact with the pipette tip is confirmed based on the marker directly or relatively.

5 Claims, 7 Drawing Sheets

PIPETTE TIP

CROSS-REFERENCE TO RELATED APPLICATIONS

The present application is a U.S. National Phase of PCT/JP2014/067153 filed on Jun. 27, 2014. The disclosure of the PCT Application is hereby incorporated by reference into the present Application.

TECHNICAL FIELD

The invention relates to a pipette tip to befitted to a pipette that is a liquid dispensing apparatus.

BACKGROUND ART

A liquid dispensing apparatus, called as a pipette or a micro pipette, capable of being held by hand, and operated manually or electrically (hereinafter, called as "pipette"), sucks and dispenses a volume of liquid that is equivalent to a volumetric change of air, the volumetric change of air is defined as a volume change inside the pipette by a movable piston provided inside the pipette, into a pipette tip to be fitted to a tip end of the pipette.

As shown in FIG. 12, a prior pipette tip 200 is made of a transparent or translucent resin such as a polyethylene, polypropylene, or polystyrene. The pipette tip 200 is formed in a tubular-thin-truncated cone shape, and equipped with an opening portion 210 at its base end 200*b* to be fitted to a pipette and an opening portion 220 at its tip end 200*t* for sucking liquid. Such pipette tip is provided between a main body of the pipette and a sample liquid, and is disposable. Contamination among samples is prevented by using the pipette tip, so that the pipette is widely used in laboratories and medical practice sites. A pipette tip improved its barrier function (Patent Reference 1) and a pipette tip equipped with a configuration for facilitating detachment (Patent Reference 2) have been proposed.

PRIOR TECHNICAL PUBLICATIONS

Patent References

Patent Reference 1: JPA 2006-231326
Patent Reference 2: JPA 2013-136052

SUMMARY OF THE INVENTION

Problem to be Solved by the Invention

A pipette is recognized and used as a convenient and accurate liquid dispensing apparatus. However, in order to secure a precise suction volume, knowledge about a principle of the apparatus and operation skill are needed. A pipette sucks and dispenses liquid by pressure change of air, so that the pipette is influenced by hydraulic pressure corresponding to depth of the liquid in contact with the pipette tip (depth measured from a liquid surface at the tip end of the pipette tip, refer to FIG. 1). For example, when the pipette tip is immersed deeply more than necessary with respect to a set suction volume, a dispensing error is probably generated by the hydraulic pressure. Therefore, the depth of the liquid in contact with the pipette tip during a suction work is important, control of a surface in contact with liquid is necessary in a few millimeters with respect to each set suction volumes. In addition, when the tip end of the pipette tip is immersed in the liquid more deeply than a specified depth, extra liquid adheres on a surface of a wet-portion of the pipette tip, and it is known that the extra liquid causes a dispensing volume error.

Besides, the sample liquid is in various containers, for example, in a small container such as a microtube, the depth of the liquid in contact with the pipette tip is not confirmed easily during a suction work. Also, when the sample liquid is colored or translucent, confirming the depth of the liquid in contact with the pipette tip is quite difficult.

The present invention has been made based on the problems of the conventional art, and an object thereof is to provide a pipette tip having a visual indicator enabling confirmation of the depth of the liquid in contact with the pipette tip during a suction work for stabilizing a suction volume and a dispensing volume of a pipette.

Means for Solving the Problems

In view of the problems above, one mode of the present invention is a pipette tip with a tubular shape, including, an opening portion at its tip end for making sucked liquid pass, an opening portion at its base end to be fitted to a pipette, and at least one marker for confirming depth of the liquid in contact with the pipette tip is formed on an outer surface of the pipette tip in a circumference direction in a tip end area of the pipette tip.

Generally, when conducting a suction of a sample liquid with a pipette, a pipette operator looks at a liquid surface of the sample liquid from an upper or an obliquely upper direction, confirms the tip end of the pipette tip is in the sample liquid, adjusts depth of the liquid in contact with the pipette tip while looking a depth of the tip end of the pipette tip, and conducts a suction work at a constant speed by pushing an operation button at a constant force, then, a constant suction volume will be obtained securely. However, it is easily understood that the series of working is difficult. Searching for a preferred depth of the liquid in contact with the pipette tip and keeping the position are responsible for the difficulty. That is the reason why the depth of the liquid in contact with the pipette tip (immersion amount) is hardly observed. That is, refractive indexes are different between air and liquid, and the pipette tip is vertically in contact with a liquid surface. Meanwhile, the pipette operator looks at the liquid surface of a sample liquid from an upper or an obliquely upper direction. Therefore, the depth of the liquid in contact with the pipette tip is hardly observed.

In the mode of the present invention, a maker is formed in a circumference direction on an outer surface of the tip end area that is to be a wet-portion of the pipette tip, so that the depth of the liquid in contact with the pipette tip is easily confirmed based on the marker directly or relatively during a suction work with a pipette.

In the mode of the present invention, it is preferable that the marker is integrally resin molded with the pipette tip. It is more preferable that the marker is integrally molded with the pipette tip made of a resin by once molding. The marker may be formed by a printing, the similar effect described above can be obtained. However, integral molding with the pipette tip, furthermore, integral molding by once molding improve a preventing effect of contamination.

In the mode of the present invention, it is further preferable that at least one marker forms a pattern in a circumference direction and a plurality of patterns are formed in an axial direction. The pattern formed in the circumference direction expands in the axial direction, so that each of the patterns acts as a scale as like.

Effect of the Invention

The present invention enables a confirmation and adjustment of a depth of the liquid in contact with the pipette tip during a suction work, and enables a stabilization of a suction volume and a dispensing volume of a pipette.

Embodiments for Implementing Invention

A preferred embodiment of the present invention will be described with reference to the drawings. FIG. 1 illustrates a pipette 1 fitted with a pipette tip 2 according to one embodiment of the present invention. In the drawing, the pipette tip 2 is depicted its outline by a dashed line. The pipette 1, for example, is a handy type electrically operable pipette having an entire length of about 280 mm. The pipette 1 includes, in a vertically long cylindrical main casing, a cylinder 12 for sucking and dispensing a sample liquid, a piston 13 that reciprocally moves in a vertical direction in the cylinder 12, a ball screw 15 connected to the piston 13 for moving the piston 13 in the vertical direction, a stepping motor 16 for rotatably driving the ball screw 15 in a clockwise and an anticlockwise direction reciprocally, and a rechargeable battery 10. On the main casing of the pipette 1, a user interface 11, a release switch 18 for detaching the pipette chip 2, an operation switch 14 for activating a suction work, and a finger rest 19 acting as a support assistance during the suction work are provided. A chip holder 17 is detachably engaged with a bottom part of the main casing 1. A bottom end of the chip holder 17 acts as a pipette tip fitting portion 1*d*. Hereinafter, in the description of the present application, a perpendicular direction of the pipette tip 2 is described based on the state that the pipette tip 2 is fitted to the pipette 1 (state in FIG. 1). Next, preferred embodiments of the pipette tip 2 will be described.

First Embodiment

FIG. 2 is a side view of the pipette tip 2 of the first embodiment, FIG. 3 is a perspective view of the pipette tip 2 from a downward direction, and FIG. 4 is a cross section (cross section along the IV-IV line in FIG. 2) of the pipette tip 2.

The pipette tip 2 is made of a resin having a preferred transmittance including a transparent or translucent resin such as a polyethylene, a polypropylene, or polystyrene (including a colored resin). The pipette tip 2 has a tubular portion 2*m* for containing a sample liquid, an opening portion 22 for making sucked liquid pass at the bottom end of the tubular portion 2*m*, and an opening portion 21 to be fitted to the pipette tip fitting portion 1*d* of the pipette 1 at the top end of the tubular portion 2*m*. Hereinafter, the top end of the pipette tip 2 is called as a base end 2*b*, the bottom end of the pipette tip 2 is called as a tip end 2*t*.

An inner and/or an outer diameter of the tubular portion 2*m* becomes thinner toward the opening portion 22 of the tip end 2*t* from the opening portion 21 of the base end 2*b* with a smooth surface. A whole shape of the pipette tip 2 is formed in a thin truncated cone shape. On an inner circumferential surface of the opening portion 21 of the base end 2*b* of the pipette tip 2, a fitting rib having a known shape, its drawing is omitted, is formed. The pipette tip 2 is fitted to the pipette tip fitting portion 1*d* by an elastic force of the fitting rib. The whole shape of the pipette tip 2, that is, the shape tubular portion 2*m* and each dimension of the opening portions 21, 22 in the figures is one example, and the shapes may be selected from among many shapes and sizes based on a suction volume of a sample liquid, a property of the sample liquid, and its container. The whole shape and the inner circumferential surface shape are similar to the others embodiments described later.

Now, a characteristic of the pipette tip 2 of the first embodiment is a plurality of markers 23 formed in a designated area in the tip end 2*t* side (a tip end area 20) of the tubular portion 2*m*.

On an outer surface 2*s* of the tip end area 20, a plurality of cylindrical portions are formed from the tip end 2*t* toward the base end 2*b* along the axial direction with each stepwise increasing its outer diameter. Specifically, in the first embodiment, a first cylindrical portion 231 at the tip end 2*t* has the smallest outer diameter. A second cylindrical portion 232, a third cylindrical portion 232, a fourth cylindrical portion 234, and a fifth cylindrical portion 235 are formed with each stepwise increasing its outer diameter in this order. A sixth cylindrical portion 236 at the topmost portion (the base end 2*b* side) has the largest outer diameter but smaller than the outer diameter of the tubular portion 2*m*. Each axial length of the cylindrical portions 231, 232, 233, 234, 235, and 236 is the same (a ratio of lengths is 1:1:1:1:1:1). In the first embodiment, an outer shape of the tip end area 20 has a stepped cylindrical shape, so that each marker 23 forms a pattern of each of stepping portions generated at each border of the cylindrical portions 231, 232, 233, 234, 235, and 236. Thus, the maker 23 is formed with a border having a concave-convex shape in the tip end area 20 in the axial direction.

The pipette tip 2 of the first embodiment is formed, for example, by making a shape corresponding to the stepped cylindrical shape described above on a cavity side mold, fitting the cavity side mold to a core side mold, injecting a resin, separating the core side mold, and moving a cavity side pushing pin. The pipette tip 2 is easily detached from the cavity side mold thereby the markers 23 are integrally molded with the pipette tip 2 by once molding.

(Modification of the First Embodiment)

FIG. 5 is a side view of the pipette tip of a modification of the first embodiment. The markers 23 as described above may be formed in non-equal intervals having a preferred rule in the axial direction. That is, as shown in FIG. 5, the ratio of the lengths of the first cylindrical portion 231, the second cylindrical portion 232, and the third cylindrical portion 233 is 1:2:3 thereby the plurality of the markers 23 are disposed in proportional intervals in the axial direction. The markers 23 are integrally molded with the pipette tip 2 by once molding, by conducting the similar molding to the first embodiment.

Second Embodiment

FIG. 6 is a side view of the pipette tip of the second embodiment. The description of elements which are similar to those of the first embodiment are omitted by using the same symbols. In the second embodiment, the marker 23 has a plurality of rectangle ribs each projecting toward exterior direction and extending along the axial direction in the tip end area 20. The markers 23 form a pattern that a few of the rectangle ribs are formed in the circumference direction on the outer surface 2*s* in the tip end area 20, furthermore, a plurality of the circumference patterns are formed in the axial direction. Specifically, in the second embodiment, four ribs are formed in the circumference direction in equal intervals, four patterns each formed of the four ribs are formed in the axial direction in equal intervals.

In the second embodiment, the pipette tip 2 is formed, for example, by making a shape corresponding to the patterns described above on a cavity side mold, fitting the cavity side mold to a core side mold, injecting a resin, separating the core side mold, and moving a cavity side pushing pin. The pipette tip 2 is easily detached from the cavity side mold thereby the markers 23 are integrally molded with the pipette tip 2 by once molding.

(Modification of the Second Embodiment)

FIG. 7 is a side view of the pipette tip of a modification of the second embodiment. FIG. 8 is a side view of the pipette tip of another modification of the second embodiment. As shown in FIG. 7, the marker 23 in the second embodiment may be formed with a rib having triangular shape having tapering toward the tip end 2*t* side. As shown in FIG. 8, the marker 23 may be formed with a rib having a semi-cylindrical shape tapering toward the tip end 2*t* side. The markers 23 of these modifications are integrally molded with the pipette tip 2 by once molding, by conducting the similar molding to the second embodiments.

Third Embodiment

FIG. 9 is a side view of the pipette tip of the third embodiment. The description of elements which are similar to those of the first embodiment is omitted by using the same symbols.

In the third embodiment, the markers 23 are formed at the same position of the ribs in the second embodiment, and each of the markers 23 is formed of a plurality of rectangle embossments each extending in the axial direction. Specifically, in the third embodiment, four embossments are formed in the circumference direction in equal intervals on the outer surface 2*s* in the tip end area 20, three patterns each formed with the four embossments are formed in the axial direction in equal intervals.

In the third embodiment, the pipette tip 2 is formed, for example, by reducing luster corresponding to the patterns described above on a cavity side mold by a fine unevenness working (emboss processing), fitting the cavity side mold to a core side mold, injecting a resin, separating the core side mold, and moving a cavity side pushing pin. The pipette tip 2 is easily detached from the cavity side mold thereby the markers 23 are integrally molded with the pipette tip 2 by once molding with a surface state (an opaque surface) different from the pipette tip 2.

(Modification of the Third Embodiment)

FIG. 10 is a side view of the pipette tip of a modification of the third embodiment. FIG. 11 is a side view of the pipette tip of another modification of the third embodiment. As shown in FIG. 11, each of the markers 23 in the third embodiment may be formed with a checkered patterned embossments (checkered pattern having a regular rule in a geometric). As shown in FIG. 10, each of the markers 23 may be formed with twin triangles facing each other. The markers 23 of these modifications are integrally molded with the pipette tip 2 by once molding, by conducting the similar molding to the third embodiment.

According to the above embodiments and modifications, during a liquid suction work with the pipette 1, a pipette operator can determine the depth that the tip end 2*t* of the pipette tip 2 should be immersed in the liquid, in other words, the depth in contact with the liquid "d" of the pipette tip 2 shown in FIG. 1, with looking at the liquid surface from an upper or an obliquely upper direction, by referring any one of markers 23 formed on the outer surface 2*s* of the pipette tip 2 directly or relatively, not by looking at the depth of the tip end 2*t* of the pipette tip 2 from the liquid surface of the sample liquid as conventional. Therefore, the pipette operator can confirm and adjust the depth of the liquid in contact with the pipette tip "d" easily even though the sample liquid is colored or translucent, or its container is small.

In view of the above description, a region of the tip end area 20 equipped with the markers 23 within the tubular portion 2*m* may be changed in accordance with a suction volume of the pipette tip 2 based on a thought of a skilled technician. Each of the regions of the tip end area 20 in Figures is one example.

In the above embodiments and modifications, since a plurality of markers 23 are formed in the axial direction within the tip end area 20, each marker acts as a scale. Therefore, controlling of the depth of the liquid in contact with the pipette tip "d" with respect to the suction volume is easily and certainly conducted.

In the above embodiments and modifications, since the marker 23 is integrally formed with the pipette tip 2 by once molding, a gap between the markers 23 and the tubular portion 2*m* of the pipette tip 2 is not generated, and contamination of liquids is prevented. Each of the markers 23 is preferably formed with a concave-convex shape and/or a design capable of molding with the pipette tip 2 within the tip and area 20, and is further preferably formed with a concave-convex shape and/or a design obtained by once molding. Each of the shapes in FIGS. 2 to 11 is one example of the marker 23 obtained by once molding, the shapes may be changed based on a thought of a skilled technician. Also, the number of the markers 23 and the interval in the circumference and axial direction in FIGS. 2 to 11 are one example respectively, the number and the interval may be changed based on a thought of a skilled technician.

DESCRIPTION OF SYMBOLS

Figure 1:
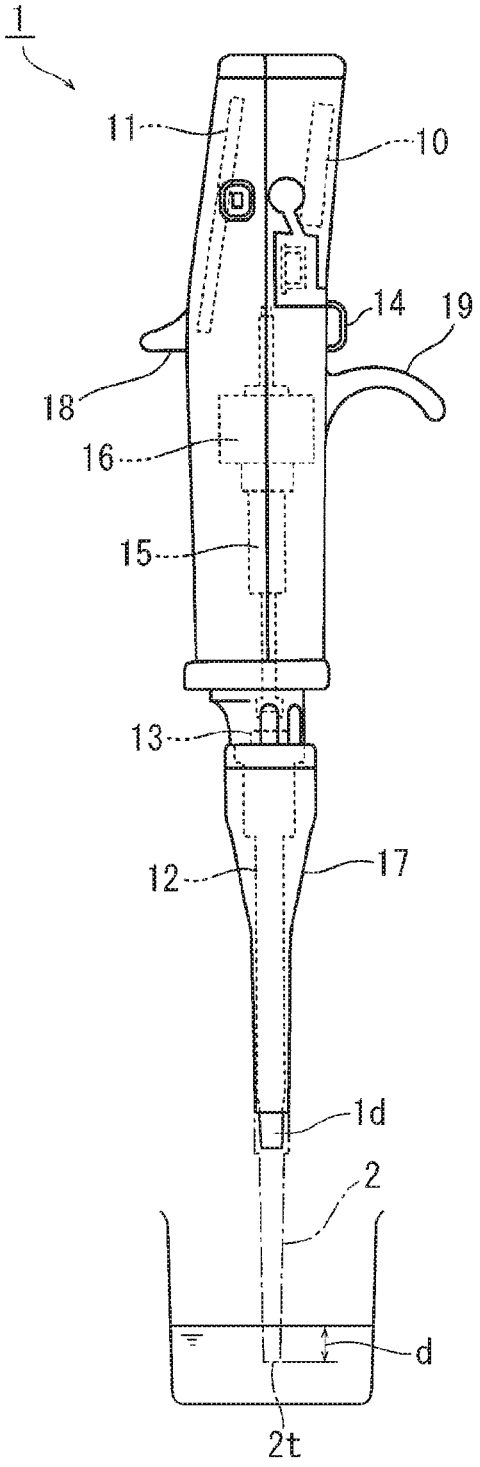
FIG. 1 illustrates a pipette tip fitted to a pipette in common in each embodiment.
Figure 2:
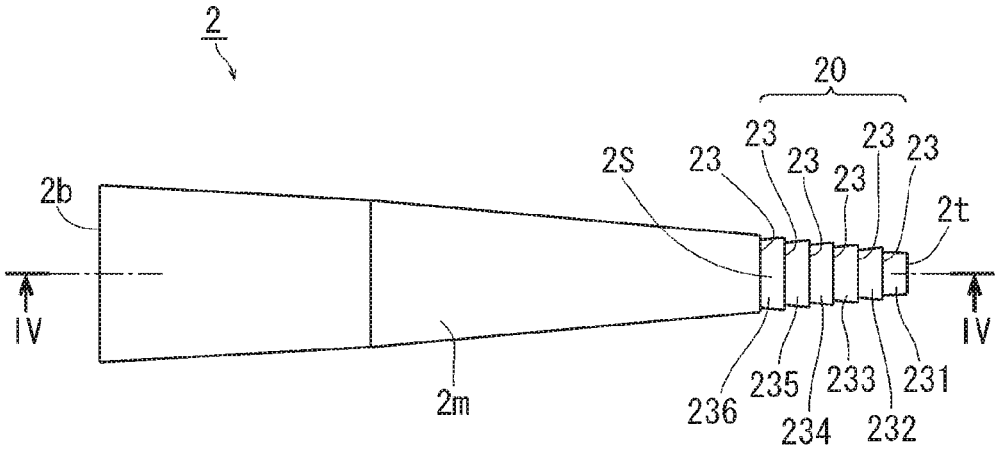
FIG. 2 is a side view of the pipette tip of first embodiment.
Figure 3:
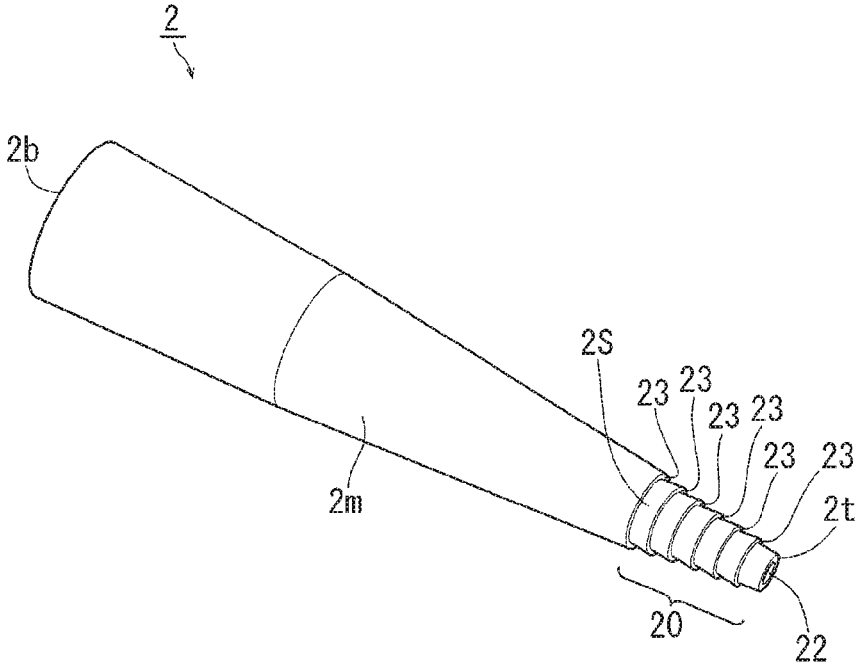
FIG. 3 is a perspective view of the pipette tip from a downward direction.
Figure 4:
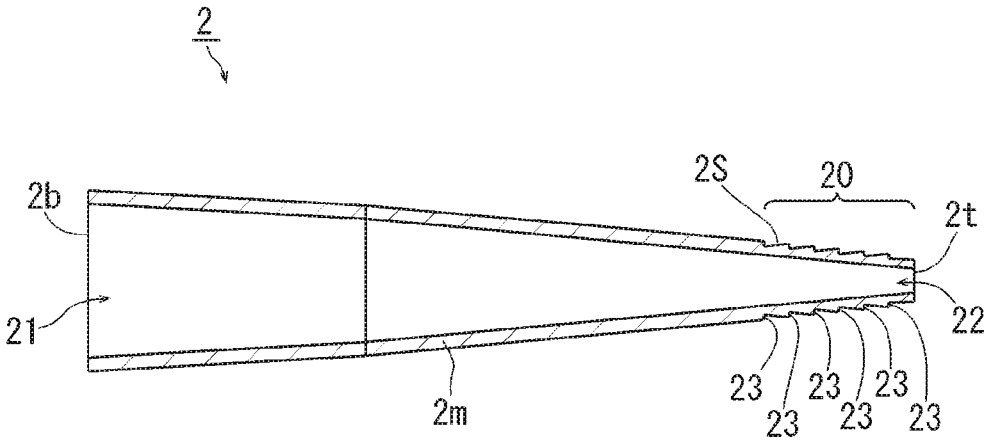
FIG. 4 is a cross section of the pipette tip 2.
Figure 5:
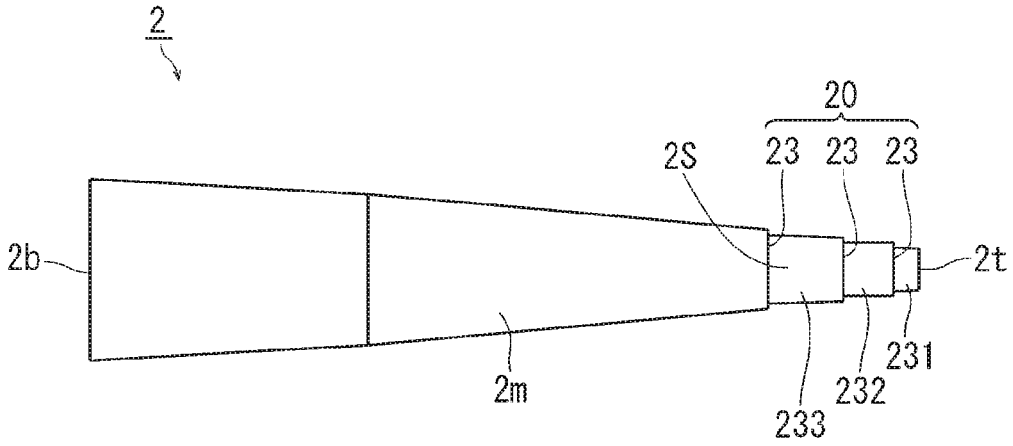
FIG. 5 is a side view of the pipette tip of a modification of the first embodiment.
Figure 6:
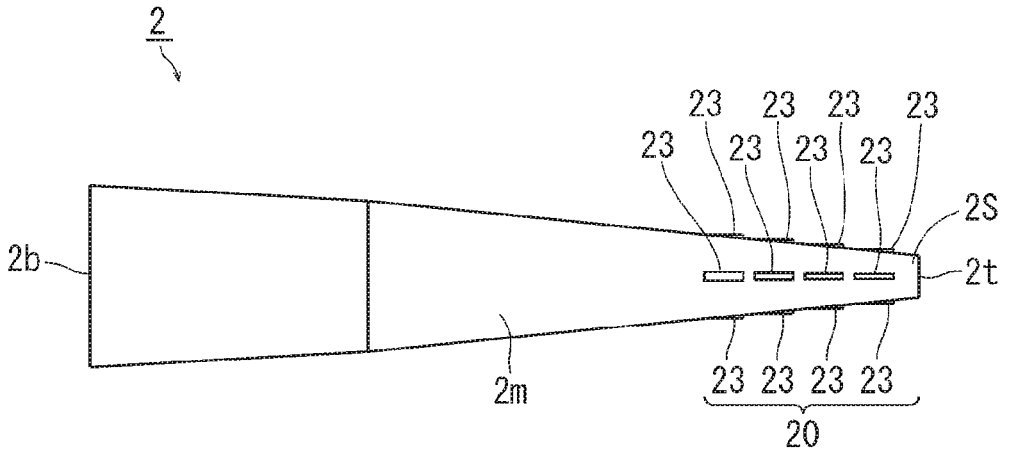
FIG. 6 is a side view of the pipette tip of second embodiment.
Figure 7:
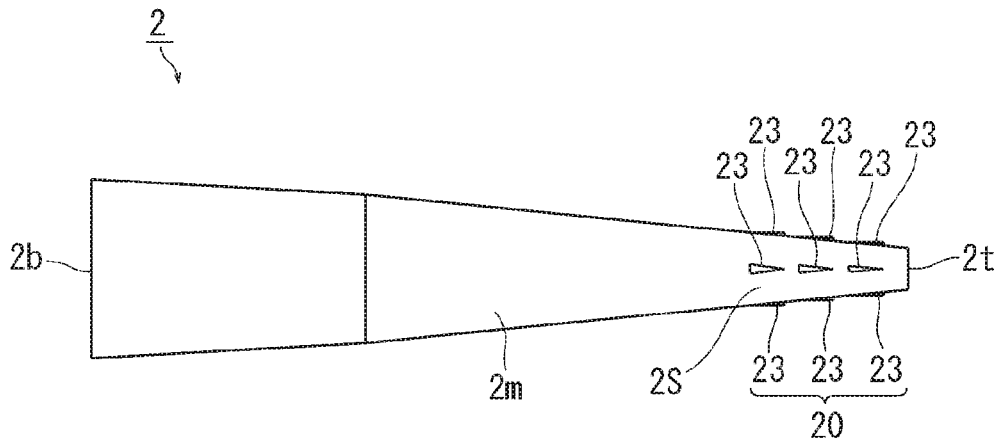
FIG. 7 is a side view of the pipette tip of a modification of the second embodiment.
Figure 8:
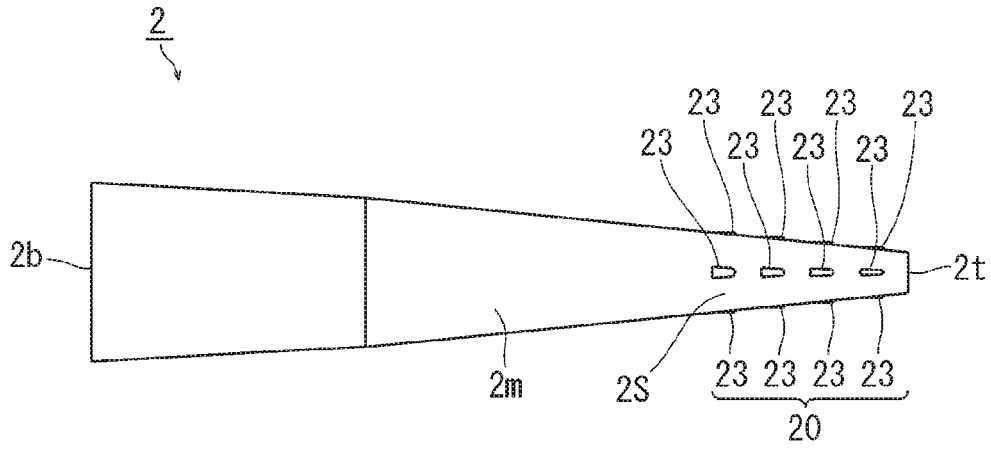
FIG. 8 is a side view of the pipette tip of another modification of the second embodiment.
Figure 9:
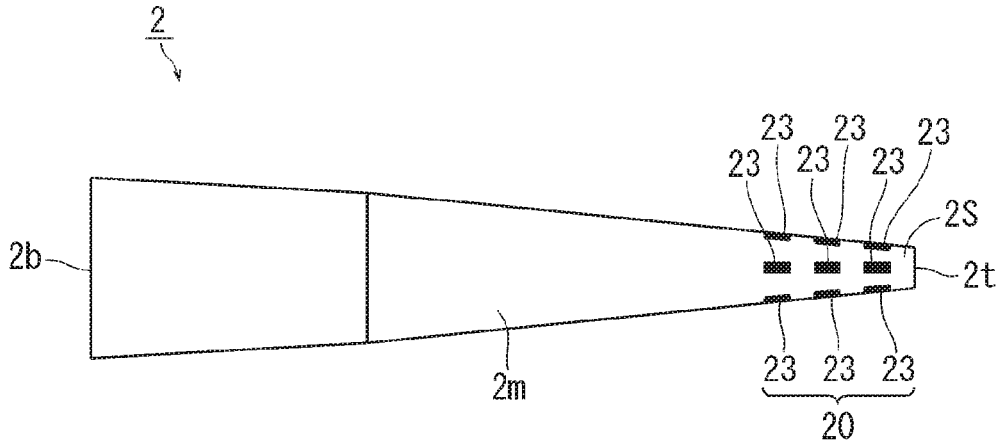
FIG. 9 is a side view of the pipette tip of third embodiment.
Figure 10:
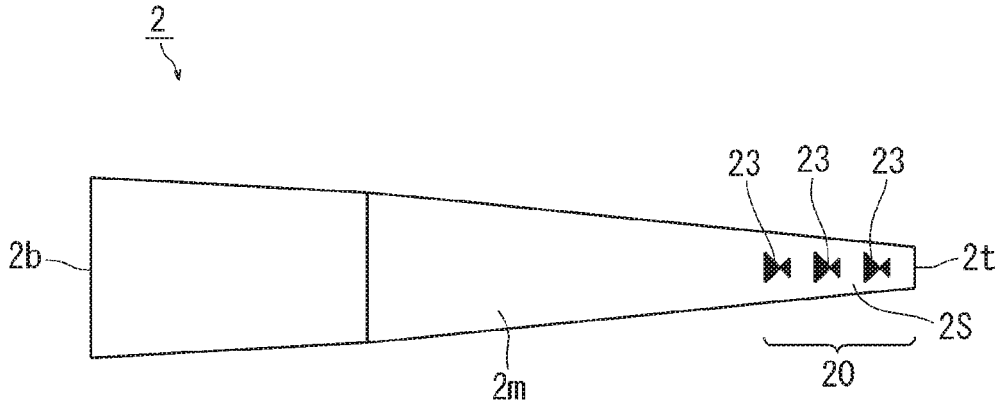
FIG. 10 is a side view of the pipette tip of a modification of the third embodiment.
Figure 11:
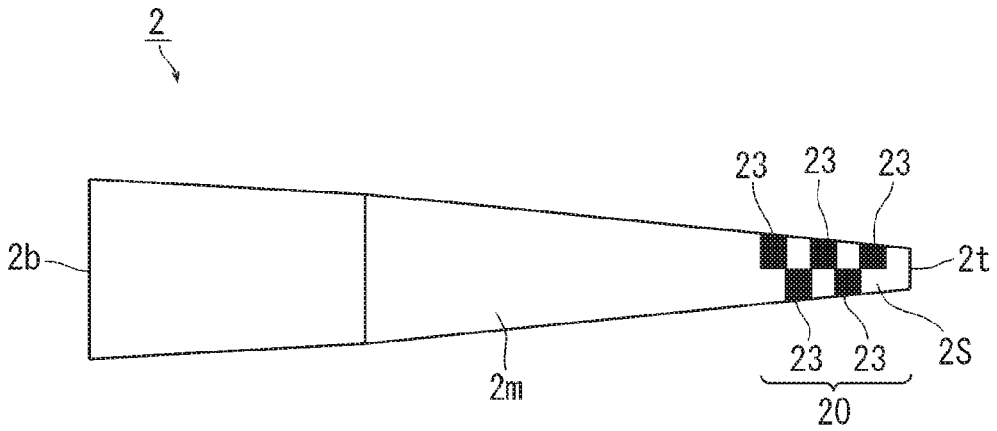
FIG. 11 is a side view of the pipette tip of another modification of the third embodiment.
Figure 12:
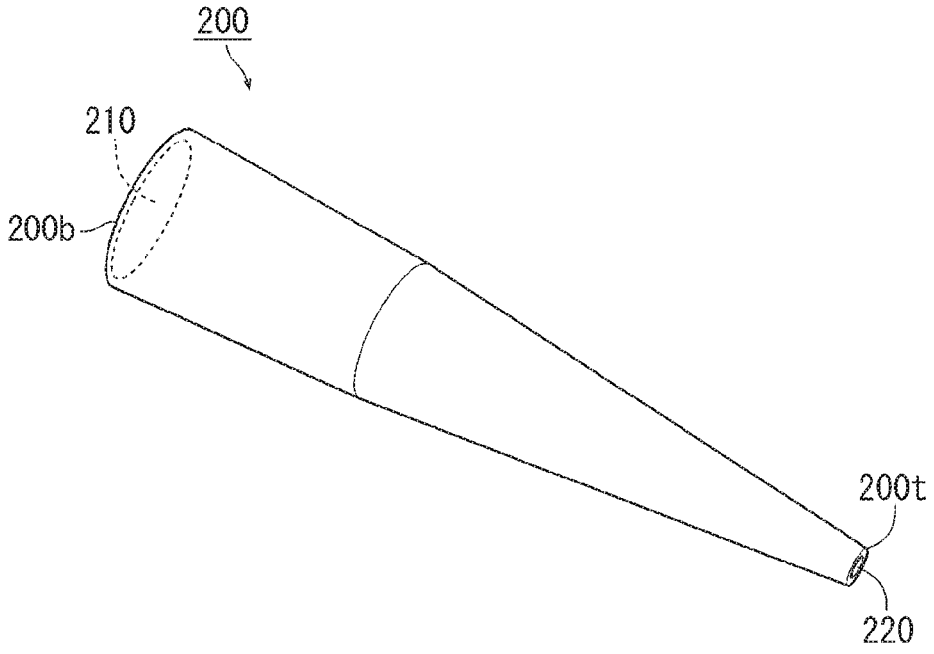
Fig. 12 Prior Art
FIG. 12 is a perspective view of a conventional pipette tip from a downward direction.

1 Pipette
1*d* Pipette tip fitting portion
2 Pipette tip

2*s* Outer surface
2*m* Tubular portion
2*b* Base end
2*t* Tip end
20 Tip end area
21 Opening portion of base end side
22 Opening portion of tip end side
23 Marker
d Depth of liquid in contact with pipette tip

The invention claimed is:

1. A pipette tip with a tubular shape, comprising:

an opening portion at its tip end for making sucked liquid pass;

an opening portion at its base end to be fitted to a pipette, and at least one marker for confirming depth of the liquid in contact with the pipette tip, the depth being determined by comparing the position of the marker with a liquid surface at the tip end of the pipette tip during a suction operation, the marker being formed on an outer surface of the pipette tip in a circumference direction exclusively on a distal tip end area of the pipette tip, and wherein circumferential outer edges of the marker along an axial direction of the pipette tip are substantially parallel to the to the outer surface of pipette tip.

2. The pipette tip according to the claim 1, wherein the marker is integrally resin molded with the pipette tip.

3. The pipette tip according to the claim 1, wherein the marker is integrally molded with the pipette tip made of a resin by a single molding operation.

4. The pipette tip according to the claim 1, wherein the marker has a shape capable of molding with the pipette tip made of a resin by a single molding operation.

5. The pipette tip according to claim 1, wherein at least one marker forms a pattern in a circumference direction and a plurality of patterns are formed in an axial direction.

* * * * *